US005234312A

United States Patent [19]

Hirose

[11] Patent Number: 5,234,312

[45] Date of Patent: Aug. 10, 1993

[54] LOADING UNIT ATTITUDE CONTROL SYSTEM

[75] Inventor: Koji Hirose, Osaka, Japan

[73] Assignee: Toyo Umpanki Co., Ltd., Osaka, Japan

[21] Appl. No.: 836,858

[22] Filed: Feb. 19, 1992

[30] Foreign Application Priority Data

Feb. 27, 1991 [JP] Japan ..... 3-17210[U]

[51] Int. Cl.[5] ..... F02F 3/00

[52] U.S. Cl. ..... 414/700; 91/182; 91/189 A; 91/513; 91/534

[58] Field of Search ..... 414/699, 700; 91/189 R, 91/189 A, 182, 513, 534

[56] References Cited

U.S. PATENT DOCUMENTS

| | | | |
|---|---|---|---|
| 3,032,215 | 5/1962 | French et al. | 414/700 |
| 3,133,653 | 5/1964 | Anderson | 414/700 |
| 3,251,277 | 5/1966 | Stacey | 91/517 |
| 3,872,990 | 3/1975 | York | 414/700 |

FOREIGN PATENT DOCUMENTS 161952 10/1988 Japan .

*Primary Examiner*—Michael S. Huppert
*Assistant Examiner*—Donald W. Underwood
*Attorney, Agent, or Firm*—Griffin, Butler, Whisenhunt & Kurtossy

[57] ABSTRACT

A loading vehicle has a boom pivotally mounted thereon for movement in a vertical plane, the boom supporting a loading unit at its distal end. A fluid control system includes a boom cylinder for raising and lowering the boom, a loading unit cylinder for tilting the loading unit relative to the boom, a tank for holding fluid and a pump for selectively pumping fluid to the cylinders through manually controlled selector valves. The loading unit attitude is controlled by a system including a bypass valve, a flow splitting valve and a boom position detector for actuating the bypass valve. Fluid forced from a lowering chamber of the boom cylinder as the boom is raised is applied to the bypass valve. As long as the boom is in a position falling within a lower range of positions the boom position detector does not actuate the bypass valve and all fluid from the lowering chamber is diverted to the tank. When the boom moves out of the lower range of positions the detector actuates the bypass valve and it diverts all fluid from the lowering chamber to the flow splitting valve which splits the flow. A first split flow is returned to the tank and a second split flow is applied to a lowering chamber of the loading unit cylinder to tilt the loading unit relative to the boom as the boom is raised.

3 Claims, 5 Drawing Sheets

LOADING UNIT ATTITUDE CONTROL SYSTEM

FIELD OF THE INVENTION

The present invention relates to an improvement in automatic control systems for controlling the attitude of a loading unit such as a bucket associated with a loading vehicle such as a shovel or front end loader.

BACKGROUND OF THE INVENTION

It is well known that a loading unit such as a bucket may be mounted on a boom carried by a loading vehicle such as a front end loader, the boom being mounted for at least vertical movement so that a load material scooped into the bucket at a lower level may be raised to a higher level to, for example, permit the load material to be dumped into a truck. Since the boom moves the bucket along an arcuate path in a vertical plane, the attitude of the bucket relative to the ground or vehicle supporting surface changes. This permits load material in the bucket to spill over the edge of the bucket. Attempts have been made to overcome this problem by providing bucket attitude control systems for automatically tilting the bucket relative to the boom as the boom is raised thus keeping the top of the bucket more nearly parallel to the surface on which the loading vehicle rests.

One prior art bucket attitude control system is operative for all positions of the boom, tilting the front edge of the bucket downwardly relative to the boom as the boom is raised. While this arrangement partially eliminates the problem of load material spill-over, particularly at higher positions of the boom, it does not solve the problem when the boom is in a lower range of positions. The reason is that the front edge of the bucket is normally tilted downwardly in order to scoop up a load, and the attitude control system tilts the front edge further downwardly as the boom is raised so there is a greater tendency for material to spill out of the bucket.

Japanese unexamined U.M. application 63-161952 discloses a loading unit attitude control system have a split flow valve which splits the flow of the fluid forced from a boom cylinder chamber as a boom is raised. One part of the split flow is diverted to a loading unit cylinder to adjust the attitude of the loading unit and the other part is returned to a sump tank. The split flow ratio may be changed depending on the output of a fluid pump so that adjustment of the loading unit attitude is independent of pump output. However, since the split flow ratio is kept constant if the pump output flow remains constant, this system suffers the same disadvantage as the system described above.

SUMMARY OF THE INVENTION

An object of the present invention is to provide a loading unit attitude control system wherein the attitude of the loading unit relative to a supporting boom is adjusted only for a higher range of boom positions.

An object of the present invention is to provide a loading unit attitude control system wherein fluid forced from a boom cylinder is split by a flow splitting valve into two flows, a first flow being returned to a sump tank and a second flow being fed into the lowering chamber of a loading unit cylinder, the system being characterized in that a bypass valve is provided between the boom cylinder and the flow splitting valve, and a boom position detector is provided for actuating the bypass valve so that all fluid from the boom cylinder is diverted to the sump tank when the boom is in a lower range of positions.

In accordance with the principles of the present invention, a loading unit attitude control system for controlling the attitude of a loading unit relative to the boom which supports it includes a boom cylinder for raising and lowering the boom, a loading unit cylinder for adjusting the attitude of the load unit, a flow splitting valve for splitting the flow of fluid from the lowering chamber of the boom cylinder as the boom is raised, the first split flow being returned to a tank and the second split flow being fed to the lowering chamber of the loading unit cylinder, the system being characterized in that a bypass valve is provided between the boom cylinder and the split flow valve for diverting the entire flow from the boom cylinder to the tank as the boom is moved through a lower range of positions. A boom position detector is provided for detecting the position of the boom and actuating the bypass valve when the boom is raised from the lower range of positions into a higher range of positions. When the bypass valve is actuated, the entire fluid flow from the boom cylinder is directed to the flow splitting valve.

The boom position detector may comprise a limit switch mounted on the boom cylinder and actuated by movement of the boom cylinder piston as the boom is moved into the higher range of positions. Alternatively the limit switch and a switch actuator may be mounted one on the boom and one on a fixed boom support. In a further embodiment the limit switch may be fixedly mounted and actuated by a cam mounted on the boom cylinder.

Other objects of the invention and its mode of operation will become apparent upon consideration of the following description and the accompanying drawings.

DETAILED DESCRIPTION OF THE INVENTION

Figure 10:
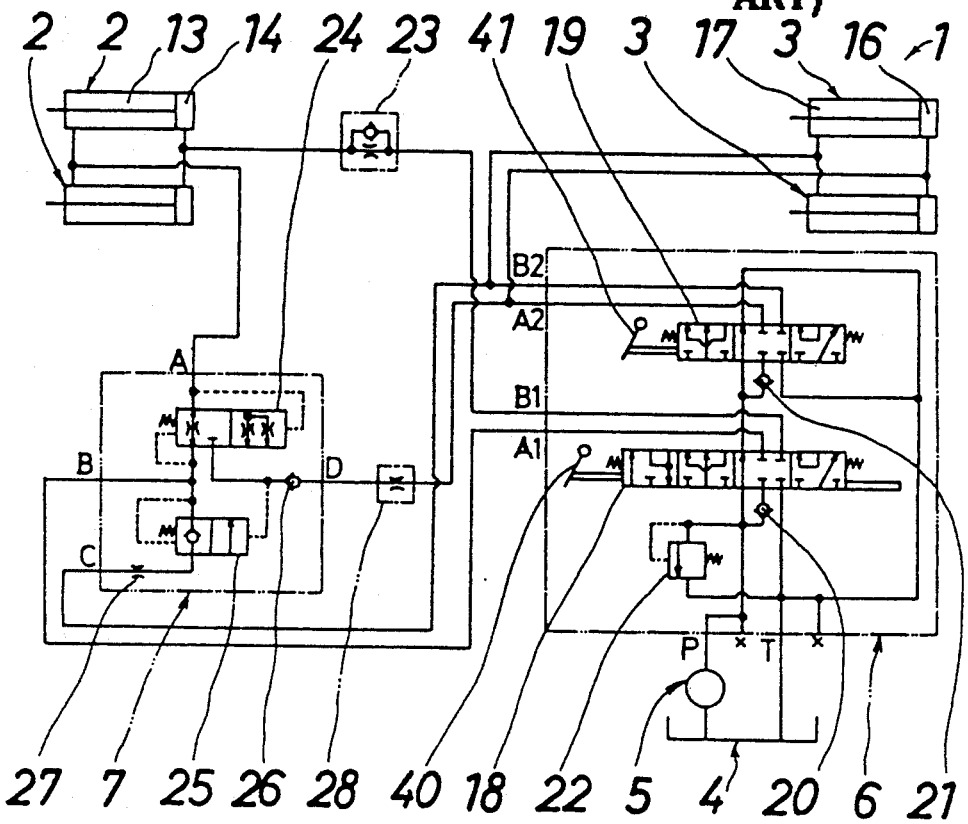
FIG. 10 (PRIOR ART)
FIG. 10 shows a loading unit attitude control circuit of the prior art; and, FIG. 11 is a side elevation of a loading vehicle with which the control circuit of FIG. 10 is used.
Figure 11:
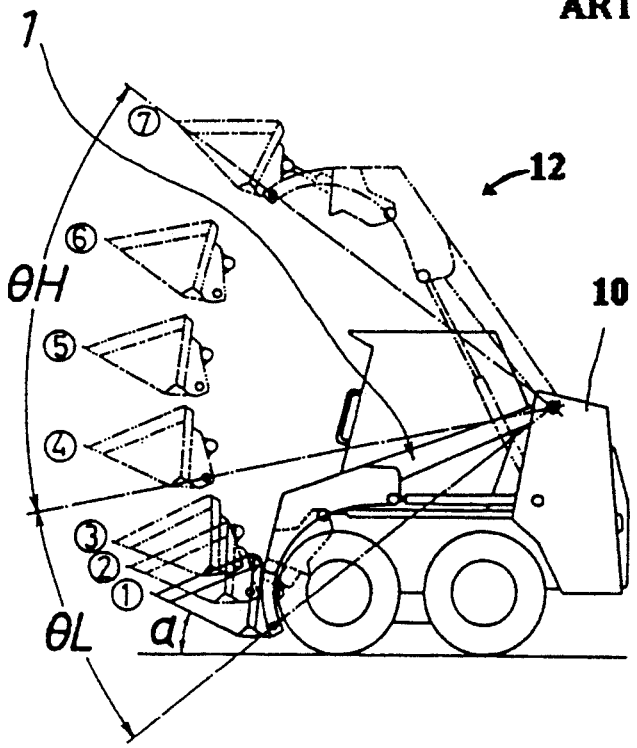
FIG. 11 (PRIOR ART)

FIGS. 10 and 11 illustrate a prior art loading vehicle 12 such as a front end loader. The vehicle 12 includes a vehicle body 10, a boom 11 pivoted at a base end on the body 10, and a loading unit or bucket 15 pivotally attached to the boom at a distal end thereof. A boom cylinder 2 is connected between the vehicle body 10 and the boom 11 to pivot the boom in a vertical plane as the cylinder is extended or retracted. A bucket cylinder 3 is connected between boom 11 and bucket 15 so that the bucket may be rotated in a vertical plane about its point of attachment to the boom.

Boom cylinder 2 and bucket cylinder 3 comprise part of a bucket attitude control device 1 illustrated in FIG. 10. The control device also includes a tank 4, a pump 5, a control valve 6, and a self-leveling valve 7.

Tank 4 contains fluid and is mounted on the body 10. The pump 5 serves to pump fluid from tank 4 and supply it under pressure to the control valve 6. The pump may be driven by a motor (not shown) such as the engine of the front end loader.

The control valve 6 has a plurality of ports P, T, A1, A2, B1 and B2. Port P is connected to pump 5 to receive fluid under pressure and port T serves as a fluid return port through which fluid may return to the tank 4. Port B1 is connected via a fluid passage and a flow restrictor check valve 23 to a raising chamber 14 of the boom cylinder 2. Port B2 is connected via a fluid passage to a raising chamber 17 of the bucket cylinder 3 and to a port C of the self-leveling valve 7. Port A2 is connected to a lowering chamber 16 of the bucket cylinder 3 and through a flow restrictor 28 to a port D of valve 7. Port A1 is connected to port B of the valve 7.

The control valve 6 comprises a boom cylinder control valve 18 for controlling the raising of boom 11 by controlling the flow of fluid to the boom cylinder 2 via port B1, and a bucket cylinder control valve 19 for controlling the flow of fluid from pump 5 to the bucket cylinder 3 via the port B2. The control valve further comprises a pressure relief valve 22 and two flow check valves 20 and 21.

The boom cylinder control valve 18 is a 4-position valve controlled by an operator by manually moving a selector lever 40. The bucket cylinder control valve 19 is a 3-position valve controlled by movement of a selector lever 41. Valves 18 and 19 are shown in FIG. 10 in their "neutral" or "hold" position whereat fluid flow to/from ports Al, A2, B1 and B2 is blocked by the valves. In this position fluid flow takes place from pump 5 through the valves 18 and 19, and back to tank 4 through port T.

When the boom cylinder control valve 18 is in the position shown in FIG. 10, the bucket 15 may be tilted upwardly or downwardly by shifting the bucket cylinder control valve 19 to the left or right. When the valve 19 is shifted to the left, fluid from pump 5 passes through check valve 21, valve 18 and port B2 to the raising chamber 17 of bucket cylinder 3 thus pivoting the front of bucket 15 upwardly. On the other hand, if valve 19 is shifted to the right from the position shown in FIG. 10, fluid in the raising chamber 17 flows through port B2 and valve 19 (left section) to the tank 4. The fluid is forced out of chamber 17 as the weight of the bucket pivots it downwardly so that a piston in the cylinder 3 reduces the size of the lowering chamber.

The boom 11 may be raised by shifting the boom cylinder control valve 18 to the left from the position shown in FIG. 10. Fluid flows from pump 5 through check valve 20, valve 18, port B1, and restrictor check valve 23 to the raising chamber 14 of boom cylinder 2 thereby expanding the chamber by moving the piston therein, the movement of the piston causing raising movement of boom 11.

The self-leveling valve 7 has four ports A, B, C and D and includes a flow splitting valve 24, an unload or dump valve 25, a check valve 26 and a throttle valve 27. Port A of valve 7 is connected via a fluid passage to the lowering chamber 13 of boom cylinder 2 while port B is connected to port A1 of valve 6. Port C is connected to port B2 of valve 6 and the raising chamber 17 of the bucket cylinder 3. Port D is connected through the flow restrictor 28 to port A2 and the lowering chamber 16 of bucket cylinder 3.

The purpose of self-leveling valve 7 is to adjust the attitude or tilt of bucket 15 as the boom 11 is raised. This is accomplished as follows. With the valve 19 in the position shown in FIG. 10, the valve 18 is shifted to the left so that fluid from pump 5 flows through valve 18, port B1 and restrictor check valve 23 to the raising chamber 14 of the boom cylinder 2. The fluid pressure in chamber 14 forces the piston in the cylinder to the left thereby raising boom 11. As the piston moves to the left it forces fluid out of the lowering chamber 13. This fluid flows into port A to the flow split valve 24. The valve 24 is spring-loaded to assume the position shown in FIG. 10 and in this position fluid may flow through a restricted passage in the valve. Because of the restricted passage, all of the fluid being forced from chamber 13 can't pass through the valve. Pressure builds up and acts against the valve to move it to the left. This connects port A with ports B and D so that the flow of fluid from chamber 13 is split into two flows. The first split flow is from port B into port A1 of valve 6, into and out of valve 18 and then through valve 19 to tank 4. The second split flow is from port D through flow restrictor 28 to the lowering chamber 16 of the bucket cylinder 3. Because of flow restrictor 28, the second split flow also actuates the spring-loaded dump valve 25.

The flow of fluid into the bucket cylinder lowering chamber 16 increases the pressure therein thus expanding the chamber by moving the piston of bucket cylinder 3. The movement of this piston to the left as viewed in FIG. 10 causes the front edge of bucket 15 to be tilted downwardly as the boom 11 is raised.

As the chamber 16 increases in size, there is a corresponding decrease in the size of raising chamber 17 so that fluid is forced therefrom. This fluid flows into port C of valve 7, through throttle valve 27, and then through dump valve 25. After passing through dump valve 25, the fluid from raising chamber 17 merges with the first split flow and is returned to tank 4 therewith.

From the foregoing description it is seen that the prior art bucket attitude control system begins tilting the front edge of the bucket 15 downwardly relative to boom 11 as soon as the boom begins to rise and continues to tilt the front edge until upward movement of the boom is stopped. As shown in FIG. 11, the front edge of bucket 15 is usually already tilted downwardly when the bucket is at its lowest position so that the front of the bucket makes an angle $\alpha$ with the ground. Since the front edge of the bucket is tilted further downwardly as the bucket is raised successively through positions 2, 3, –7, it follows that in the range of lower positions the attitude controls do not improve the attitude of the bucket but only makes it worse, decreasing the angle $\alpha$ so that there is a greater tendency for the load material in the bucket to spill over its front edge.

Figure 3:
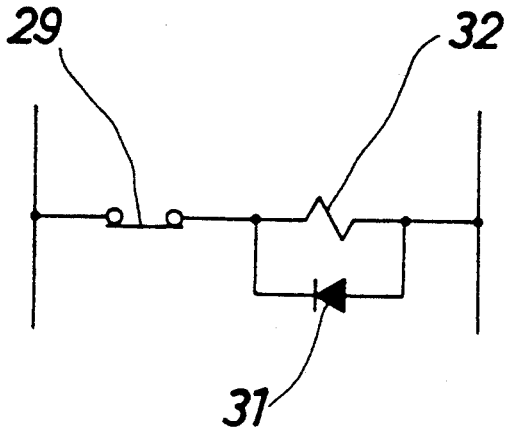
FIG. 3 illustrates an electrical circuit including a limit switch and the solenoid of a dump valve.

In accordance with the principles of the present invention, the attitude control of FIG. 10 is modified to include a springbiased solenoid-actuated valve 33 (FIG. 1) having a bypass valve 9 and an actuating solenoid 32 connected in series with a limit switch 29 (FIG. 3). A diode 31 is connected across the solenoid to suppress transients.

Figure 1:
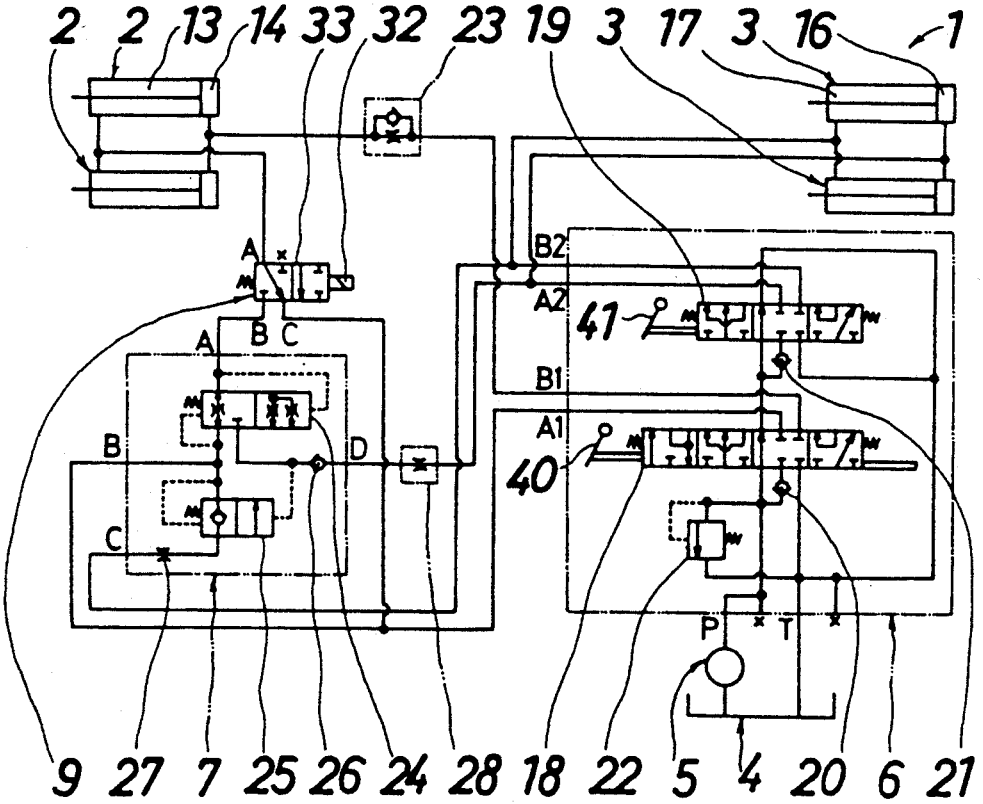
FIG. 1 is a fluid circuit diagram of a loading unit attitude control circuit constructed in accordance with the principles of the present invention.

As shown in FIG. 1, valve 9 is connected to receive all the fluid flowing from lowering chamber 13 as the boom 11 is raised. A first output port B of the valve 9 is connected to port A of valve 7 and a second output port C is connected via fluid passages to port A1 of valve 6.

Figure 2:
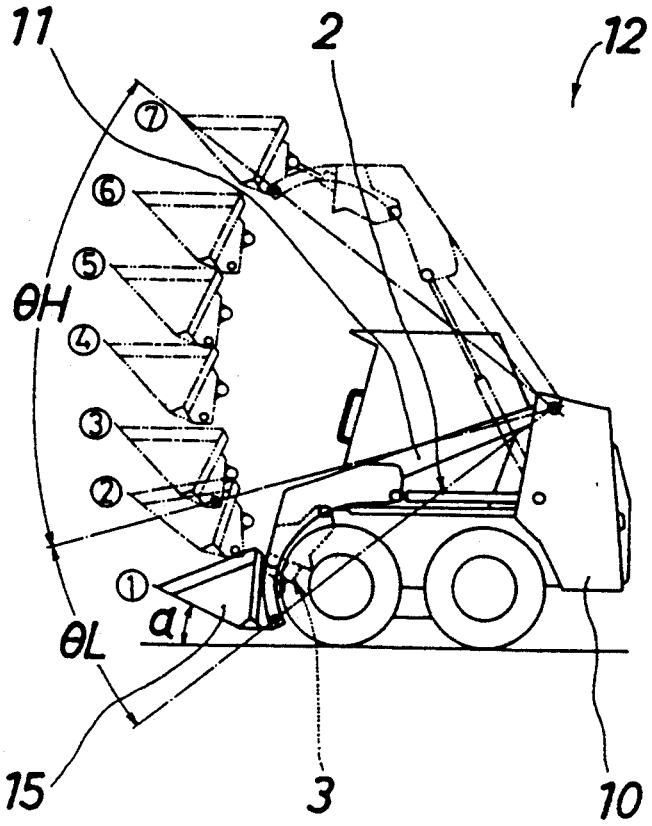
FIG. 2 is a side elevation of a loading vehicle in which the attitude control circuit may be used.

The switch 29 is actuated by a boom position detector 8 (FIGS. 4 and 5) as subsequently described. Generally speaking, switch 29 is a normally open switch which remains open as long as the boom 11 is anywhere in a lower range of positions θL (FIG. 2). When the boom moves into the higher range θH, the detector closes switch 29 thereby energizing the actuating solenoid 32 of valve 9.

The modified attitude control operates as follows. Assume that the bucket 15 is in position 1 and the operator actuates the lever 40 to raise boom 11, thereby causing fluid to flow from pump P to raise chamber 14. The boom begins to rise and fluid is forced out of lowering chamber 13. Switch 29 is not actuated so the fluid flows through valve 9 to its output port C and from there it flows through port A1 of valve 6, into an out of valve 18, and through valve 19 to the tank 4. None of the fluid being forced out of chamber 13 is directed into the raising chamber 16 of the bucket cylinder 2 so the bucket is not tilted as the boom rises. This continues until the detector detects that boom 11 has moved above the range of positions θL into the range θH. At this point the detector closes switch 29 thereby energizing the solenoid 32 of valve 9. This causes the fluid being forced out of chamber 13 to flow out of port B of valve 9 so that it is directed into port A of valve 7. The flow is the split by valve 24 as described with reference to FIG. 10 and a portion thereof is applied to the lowering chamber 16 of the bucket cylinder 2 to tilt the front edge of the bucket 15 downwardly.

From the foregoing description it is evident that bypass valve 9 prevents the tilting of bucket 15 in the range θL where such tilting would only worsen the angle of tilt of the bucket, but enables the tilt control to be active in the range θH where tilting improves the attitude of the bucket.

Figure 4:
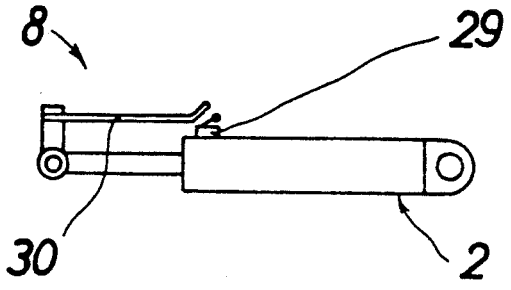
FIG. 4 illustrates a boom position detector for operating the limit switch, the detector being mounted on the boom cylinder.

The detector for detecting the position of boom 11 and actuating switch 29 can take several forms. FIG. 4 shows a first embodiment wherein limit switch 29 is mounted on the boom cylinder 2 and a lever 30 mounted on the rod of the boom cylinder actuates the switch as the boom moves out of the range θL into the range θH.

Figure 5:
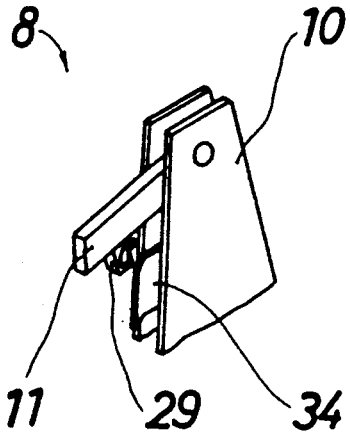
FIG. 5 illustrates a second embodiment of a boom position detector.

FIG. 5 illustrates a second embodiment of detector 8 wherein the limit switch 29 is mounted on boom 11 and is actuated by a dog 34 mounted on the vehicle body 10 or structure fixed relative to body 10.

Figure 6:
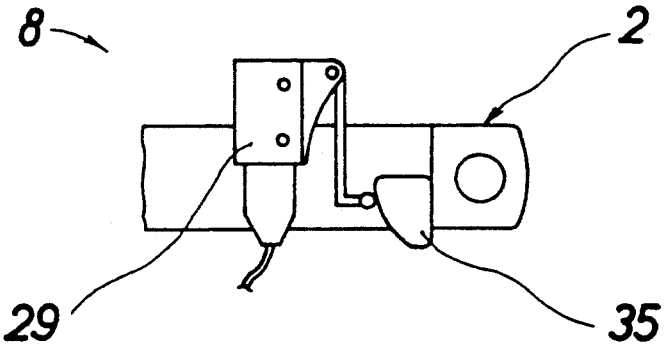
FIG. 6 illustrates a further embodiment of a boom position detector, the boom being in a lowered position.
Figure 7:
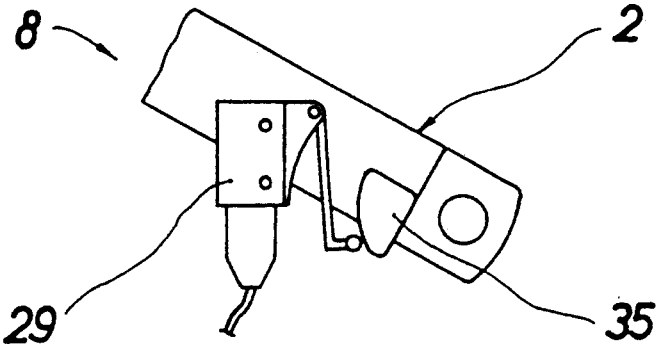
FIG. 7 shows the boom position detector of FIG. 6 when the boom is in a raised position.

FIGS. 6 and 7 illustrate a third embodiment of the boom position detector 8. In this embodiment the limit switch 29 is fixed in position relative to vehicle body 10 and a cam 35, mounted on the boom cylinder 2, actuates the switch. Boom position is thus detected by detecting the angle of the boom cylinder relative to the vehicle body. FIG. 6 shows the relative positions of the cam 35 and switch 29 when the boom is in a low position (FIG. 6) and a raised position (FIG. 7).

Figure 8:
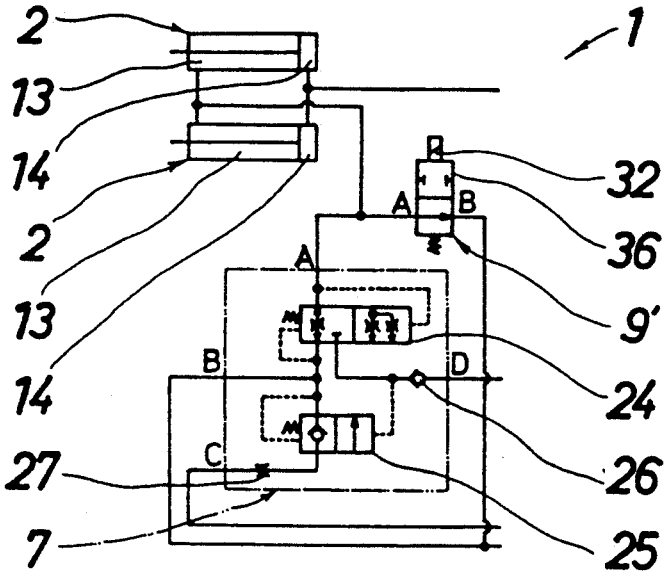
FIG. 8 illustrates a second embodiment of a loading unit attitude control circuit.

FIG. 8 shows a different arrangement of the bypass valve. In this embodiment a solenoid actuated valve 36 includes a bypass valve 9' having a single inlet port A and a single outlet port B. The A ports of both valves 7 and 9' are connected to the lowering chamber 13 of the boom cylinder 2. The B ports of both valves are connected to each other and to port A1 of valve 6.

When the boom 11 is within the range θL, solenoid 32 is not actuated and fluid flowing from lowering chamber 13 as the boom rises passes through valve 9' and flows to the tank 4 as previously described. Because ports B of valves 9' and 7 are interconnected, the pressure at port B of valve 7 rises to about the same value as that at port A. These pressures operate in opposing directions on the split flow valve 24 so that it does not move hence there is no flow to the raising chamber 16 of the bucket cylinder 3 through valve 24. The solenoid 32 of valve 9' is actuated when the boom moves from range θL into range θH so that flow through valve 9' is blocked. All of the fluid from lowering chamber 13 is therefore directed to port A of split flow valve 24 so that a portion of the split flow causes tilting of bucket 15 as previously described.

Figure 9:
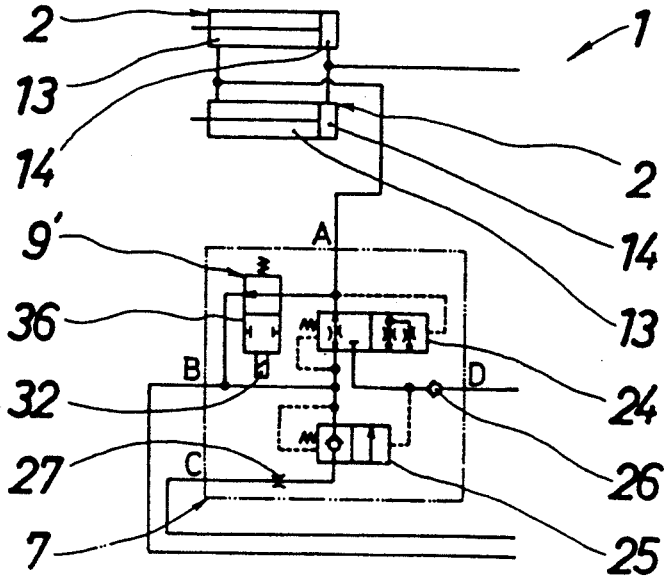
FIG. 9 shows the loading unit attitude control circuit of FIG. 8, modified to include the dump valve in the body housing the split flow valve.

The bypass valve 9 of FIG. 1 or the bypass valve 9' of FIG. 8 need not be a separate structure but may be incorporated into the body of valve 7. FIG. 9 shows the valve 9' integrated into the body of valve 7. The operation of the attitude control system of FIG. 9 is exactly the same as described above with reference to FIG. 8.

While preferred embodiments of the invention have been described in specific detail for purposes of illustration, it will be understood that various modifications may be made in the described embodiments without departing from the spirit and scope of the invention as defined by the appended claims. While the loading unit 15 has been described as a bucket, it may take other forms such as, for example, a fork. Depending on the point of attachment of the loading unit cylinder 3 to the loading unit, the loading unit cylinder may be expanded or contracted to cause raising of the front edge of the loading unit. In the embodiment of FIG. 1, the valves 7 and 9 need not be connected to the tank through valve 6 but may instead be connected directly to the tank. Finally, while the preferred embodiments utilize an electro-mechanical detector and a solenoid-actuated bypass valve, these elements may be purely mechanical. Other modifications and substitutions will be obvious to those skilled in the art.

I claim:

1. In a loading unit attitude control system having a boom pivotally supported on a loading vehicle, a loading unit pivotally supported on the boom, a boom cylinder connected between said loading vehicle and said boom for raising and lowering the boom, a loading unit cylinder connected between said loading unit and said boom for changing the attitude of the loading unit relative to the boom, a tank for holding a fluid, means for applying said fluid under pressure to a raising chamber in said boom cylinder to raise said boom, a split flow valve, means connecting the split flow valve to a lowering chamber in said boom cylinder so as to receive from said lowering chamber a fluid forced therefrom as said boom is raised, said split flow valve splitting the flow of fluid from said lowering chamber into first and second split flows, means for returning said first split flow to said tank, and means for applying said second split flow to said loading unit cylinder whereby the attitude of said loading unit relative to said boom is adjusted as the boom is raised, said loading unit attitude control system being characterized in that it includes:

a detector for detecting the position of said boom relative to a predetermined raised position, a bypass valve connected to receive the fluid forced from said lowering chamber as said boom is raised, said bypass valve being responsive to said detector for directing the fluid received from said lower chamber to said tank when said detector detects that the boom is below said predetermined raised position, said bypass valve having a single input port connected to the means connecting the split flow valve to said lowering chamber, and a single output port connected to said tank, said bypass valve being responsive to said detector for connecting said input port to said output port when said detector detects that the boom is below said predetermined raised position, and means connecting said output port to said split flow valve to prevent the flow of fluid therethrough when said boom is below said predetermined raised position.

2. In a loading unit attitude control system having a boom pivotally supported on a loading vehicle, a loading unit pivotally supported on the boom, a boom cylinder connected between said loading vehicle and said boom for raising and lowering the boom, a loading unit cylinder connected between said loading unit and said boom for changing the attitude of the loading unit relative to the boom, a tank for holding a fluid, means for applying said fluid under pressure to a raising chamber in said boom cylinder to raise said boom, a split flow valve, means connecting the split flow valve to a lowering chamber in said boom cylinder so as to receive from said lowering chamber a fluid forced therefrom as said boom is raised, said split flow valve splitting the flow of fluid from said lowering chamber into first and second split flows, means for returning said first split flow to said tank, and means for applying said second split flow to said loading unit cylinder whereby the attitude of said loading unit relative to said boom is adjusted as the boom is raised, said loading unit attitude control system being characterized in that it includes:

a detector for detecting the position of said boom relative to a predetermined raised position, and a bypass valve connected to receive the fluid forced from said lowering chamber as said boom is raised, said bypass valve being responsive to said detector for directing the fluid received from said lower chamber to said tank when said detector detects that the boom is below said predetermined raised position, said bypass valve comprising a solenoid actuated valve and said detector means comprising a switch mounted in a fixed position and having contacts for closing a circuit to energize the solenoid, and a cam mounted on the boom cylinder for actuating said contacts.

3. In a loading unit attitude control system having a boom pivotally supported on a loading vehicle, a loading unit pivotally supported on the boom, a boom cylinder connected between said loading vehicle and said boom for raising and lowering the boom, a loading unit cylinder connected between said loading unit and said boom for changing the attitude of the loading unit relative to the boom, a tank for holding a fluid, means for applying said fluid under pressure to a raising chamber in said boom cylinder to raise said boom, a split flow valve, means connecting the split flow valve to a lowering chamber in said boom cylinder so as to receive from said lowering chamber a fluid forced therefrom as said boom is raised, said split flow valve splitting the flow of fluid from said lowering chamber into first and second split flows, means for returning said first split flow to said tank, and means for applying said second split flow to said loading unit cylinder whereby the attitude of said loading unit relative to said boom is adjusted as the boom is raised, said loading unit attitude control system being characterized in that it includes:

a detector for detecting the position of said boom relative to a predetermined raised position, and a bypass valve connected to receive the fluid forced from said lowering chamber as said boom is raised, said bypass valve being responsive to said detector for directing the fluid received from said lower chamber to said tank when said detector detects that the boom is below said predetermined raised position, said bypass valve comprising a solenoid actuated valve and said detector means comprising a switch connected to selectively energize the solenoid and a dog for actuating the switch, one element of a group of elements consisting of said switch and said dog being fixedly mounted with respect to the loading vehicle and the other element of said group of elements being mounted on the boom.

* * * * *